US008867771B2

(12) United States Patent
Mei

(10) Patent No.: US 8,867,771 B2
(45) Date of Patent: Oct. 21, 2014

(54) PORTABLE VIBRATION SPEAKER

(75) Inventor: Qingkai Mei, Guangdong (CN)

(73) Assignees: Qingkai Mei, Shenzhen (CN); Donald Gordon Beasant, Shenzhen (CN)

( * ) Notice: Subject to any disclaimer, the term of this patent is extended or adjusted under 35 U.S.C. 154(b) by 0 days.

(21) Appl. No.: 13/580,380

(22) PCT Filed: Oct. 20, 2011

(86) PCT No.: PCT/CN2011/081051

§ 371 (c)(1),
(2), (4) Date: Aug. 22, 2012

(87) PCT Pub. No.: WO2012/174812

PCT Pub. Date: Dec. 27, 2012

(65) Prior Publication Data

US 2013/0170683 A1 Jul. 4, 2013

(30) Foreign Application Priority Data

Jun. 22, 2011 (CN) ..... 2011 1 0173735

(51) Int. Cl.

| | |
|---|---|
| ***H04R 25/00*** | (2006.01) |
| ***H04R 3/00*** | (2006.01) |
| ***H04R 1/00*** | (2006.01) |
| ***H04R 11/02*** | (2006.01) |
| ***H04R 1/02*** | (2006.01) |

(52) U.S. Cl.

CPC .. *H04R 1/00* (2013.01); *H04R 3/00* (2013.01); *H04R 11/02* (2013.01); *H04R 1/02* (2013.01)

USPC ..... 381/334; 381/381; 381/345

(58) Field of Classification Search

USPC ..... 381/334, 345, 387; 181/199, 149, 151, 181/152, 156

See application file for complete search history.

(56) References Cited

U.S. PATENT DOCUMENTS 4,889,208 A * 12/1989 Sugihara ..... 181/148
6,412,594 B1 * 7/2002 Small et al. ..... 181/149

(Continued)

FOREIGN PATENT DOCUMENTS

| | | | |
|---|---|---|---|
| CN | 101472210 | A | 7/2009 |
| CN | 201422158 | Y | 3/2010 |
| CN | 202111839 | U | 1/2012 |

OTHER PUBLICATIONS

PCT/CN2011/08151. Written Opinion of ISA (English Translation).*

*Primary Examiner* — Davetta W Goins
*Assistant Examiner* — Phylesha Dabney

(57) ABSTRACT

The invention discloses a kind of portable vibration speaker that is composed of an upper cover, a lower cover, and a vibrating tone generator and a control circuit (the both are fitted inside the lower cover). The inside of the upper cover is fitted with a speaker. The improvements include a blow-molded spring; one end of the blow-molded spring is connected to the upper cover, and the other end is connected to the lower cover in rotating mode; inner wall of the upper cover is provided with a buckle, and a buckle flute is arranged in a position on the lower cover corresponding to the buckle. A blow-molded spring connects the resonant sound unit and speakers into one piece so as to avoid the flaws such as poor sound effects and narrow volume range of pure resonant sound unit or conventional compact sound unit. Music of different sound quality may be given with superior sound quality effects. The portable vibration speaker is characterized by its compactness, handiness and superior bass effects, and may meet the needs of young consumers.

5 Claims, 2 Drawing Sheets

(56) References Cited

U.S. PATENT DOCUMENTS 6,752,238 B2 * 6/2004 Small et al. ..... 181/149
8,175,318 B2 * 5/2012 Pieklik et al. ..... 381/387
2002/0092864 A1 * 7/2002 Small et al. ..... 222/79
2005/0091739 A1 * 5/2005 Lerma ..... 4/541.1
2009/0213073 A1 * 8/2009 Obermeyer et al. ..... 345/161
2012/0162076 A1 * 6/2012 Obermeyer et al. ..... 345/161

* cited by examiner

PORTABLE VIBRATION SPEAKER

BACKGROUND OF THE INVENTION

The invention is related to acoustics, especially a kind of portable vibration speaker.

In recent years, a kind of resonant sound unit goes on the market, which overturns people's concept and understanding of conventional sound unit. The sounding system of this kind of resonant sound unit is not provided with vibrating diaphragms; however, it may convert the audio signals into audio mechanical vibration as per the principle of resonance, and output the audio mechanical vibration to any hard objects touched by it, such that the hard objects may serve as sounding media; the sounds are delicate, even, free of directivity, and may be spread in omni-directional mode (360°). Surround sound may be obtained, and various tone quality effects may be attained by different sounding media. The resonant sound unit is characterized by its compactness, and may be placed at your own sweet will. It may change the common hard objects such as tables, doors, windows and floor board into natural sound unit only if it is connected to the tone source equipment like computer, MP3, MP4, MD, CD, or DVD player. However, the resonant sound unit developed as per the existing technologies is not combined with a loudspeaker system. The existing resonant sound unit works as simple resonant sound unit that features a relatively narrow volume range, poorly presented treble, and some flaws. Furthermore, the bass effect of conventional compact sound unit is usually poor due to its small chambers, its sound quality is non-tunable, and its overall sound effects may not satisfy most of the young consumers.

BRIEF SUMMARY OF THE INVENTION

The invention is intended to provide a kind of portable vibration speaker that may effectively overcome the above-mentioned shortages and is provided with a wide volume range and better sound effects.

Technical proposal of the invention is implemented in this way: It is composed of an upper cover, a lower cover, and a vibrating tone generator and a control circuit (the both are fitted inside the lower cover). The inside of the upper cover is fitted with a speaker. The improvements also include a blow-molded spring; one end of the blow-molded spring is connected to the upper cover, and the other end is connected to the lower cover in rotating mode; inner wall of the upper cover is provided with a buckle, and a buckle flute is arranged in a position on the lower cover corresponding to the buckle;

In the above-mentioned structure, the vibrating tone generator is composed of a pedestal, a magnet and a surround coil. The upper end and lower end of the pedestal are provided with $1^{st}$ vibration transferring body and $2^{nd}$ vibration transferring body respectively. The both resonance transferring bodies may carry out up-and-down movement relative to the pedestal. The $1^{st}$ vibration transferring body is connected to a coil sleeve on which a surround coil is fitted. The magnet is fitted inside the coil sleeve, and a magnetizer is fitted over the magnet;

In the above-mentioned structure, the lower cover is provided with an audio input interface, power supply interface and switch, which are connected to the control circuit board;

In the above-mentioned structure, the $2^{nd}$ vibration transferring body extends out of the lower cover;

In the above-mentioned structure, the $2^{nd}$ vibration transferring body is provided with a rubber pad;

In the above-mentioned structure, the upper cover is provided with a sound hole.

Advantageous effects of the invention include the following: Firstly, in the portable vibration speaker of the invention, a blow-molded spring connects the resonant sound unit and speakers into one piece so as to avoid the flaws such as poor sound effects and narrow volume range of pure resonant sound unit or conventional compact sound unit. Its vibrating tone generator is provided with $1^{st}$ vibration transferring body and $2^{nd}$ vibration transferring body. Prior to operation, connect the audio input terminal of the portable vibration speaker to the tone source equipment, and connect the electric power supply to the power supply interface. The varying music signals are processed by the control circuit board, and enter into the surround coil such that the surround coil generates a varying magnetic field. Under the action of the varying magnetic field, $1^{st}$ vibration transferring body and $2^{nd}$ vibration transferring body start vibrating. Music of different sound quality may be given once the vibrational energy is transferred to the surface of a hard medium; the music features superior sound quality effects, and the user may enjoy the music that makes for comfort as much as he likes. Secondly, in the above-mentioned structure of the invention, $2^{nd}$ vibration transferring body is provided with a rubber pad that may effectively avoid the noises generated during vibration so as to improve the sound effects further. Thirdly, prior to operation, the blow-molded spring may be compressed such that the upper cover and lower cover may be fastened with a buckle; in such a case, the equipment may be used as an ordinary sound unit more freely. Fourthly, the portable vibration speaker features compactness, handiness and superior bass effect, and may meet the needs of young consumers.

In the figures: 1 Upper cover, 2 Lower cover, 3 Vibrating tone generator, 4 Speaker, 5 Blow-molded spring, 6 Buckle, 7 Buckle flute, 8 Pedestal, 9 Surround coil, 10 $1^{st}$ vibration transferring body, 11 $2^{nd}$ vibration transferring body, 12 Rubber pad, 13 Power supply interface, 14 Switch, 15 Audio input interface, 16 Sound hole, 17 Coil sleeve.

DETAILED DESCRIPTION OF THE INVENTION

The invention is further described as per the figures and embodiments.

Figure 1:
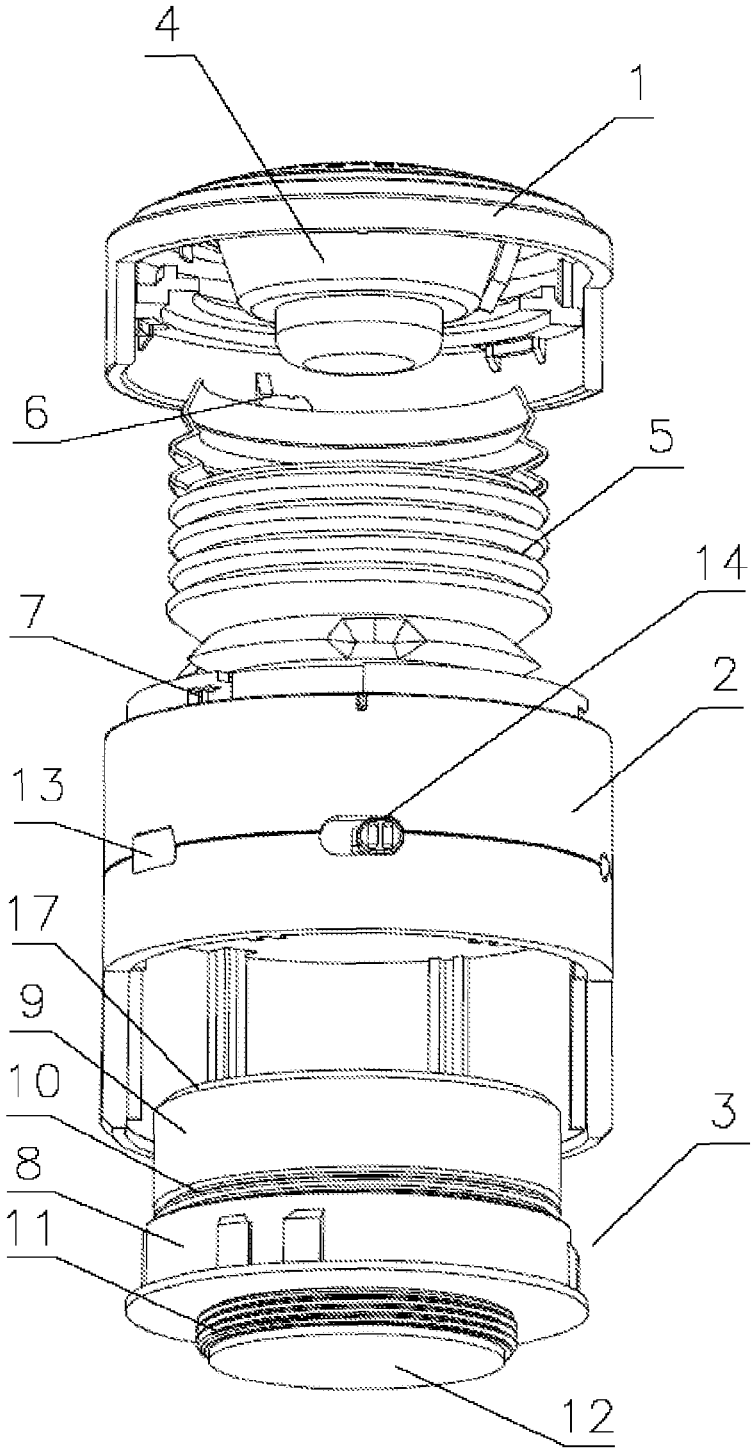
FIG. 1 shows an exploded view of the invention.
Figure 2:
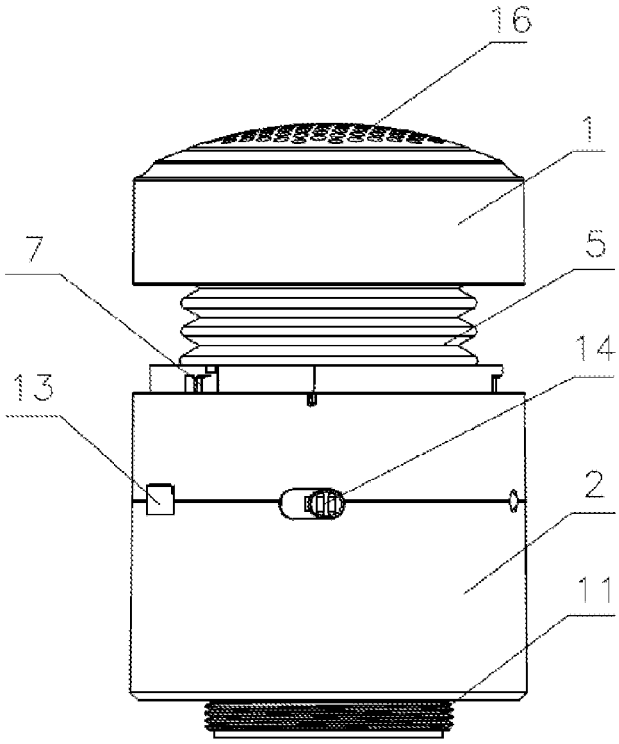
FIG. 2 shows a structural representation of the invention with its upper cover and lower cover opened.
Figure 3:
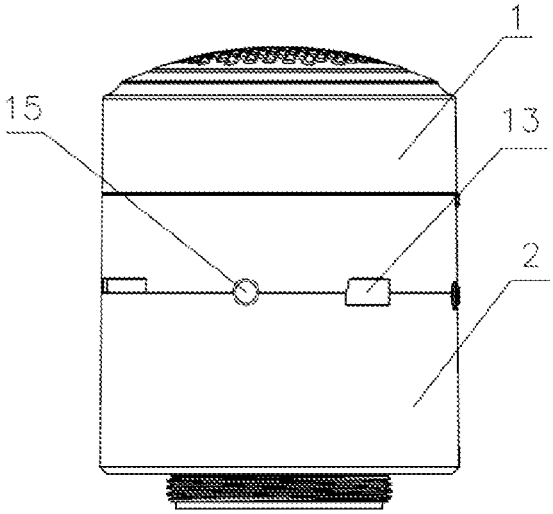
FIG. 3 shows a structural representation of the invention with its upper cover and lower cover buckled.

As shown in FIGS. 1 to 3, the invention is a kind of portable vibration speaker. It is composed of upper cover 1, lower cover 2, blow-molded spring 5 and vibrating tone generator 3 and control circuit board fitted inside lower cover 2. The inside of upper cover 1 is fitted with speaker 4. Therein, one end of blow-molded spring 5 is connected to upper cover 1, and the other end is connected to lower cover 2 in rotating mode. The blow-molded spring 5 may be rotated for a certain angle relative to lower cover 2. The inner wall of upper cover 1 is provided with buckle 6, and buckle flute 7 is arranged in a position corresponding to buckle 6 in lower cover 2. Upper cover 1 may be pushed downward such that blow-molded spring 5 may be compressed; then rotate upper cover 1 for a certain angle, and have buckle 6 on inner wall of upper cover 1 and buckle flute 7 in lower cover 2 fastened such that upper cover 1 and lower cover 2 are buckled (as shown in FIG. 3);

when the portable vibration speaker is used in such a "buckled" state, its effect is equivalent to ordinary sound unit that is free of obvious resonant effects.

In the above-mentioned structure, the vibrating tone generator 3 is composed of pedestal 8, magnet (not shown in the figure), and surround coil 9. The upper end and lower end of pedestal 8 are provided with $1^{st}$ vibration transferring body 10 and $2^{nd}$ vibration transferring body 11 respectively. The both resonance transferring bodies may carry out up-and-down movement relative to pedestal 8. The $1^{st}$ vibration transferring body 10 is connected to coil sleeve 17 on which 17 surround coil 9 is fitted. The magnet is fitted inside coil sleeve 17, and a magnetizer (not shown in the figure) is fitted over the magnet. The $2^{nd}$ vibration transferring body 11 extends out of lower cover 2; $2^{nd}$ vibration transferring body 11 is provided with rubber pad 12 that may effectively avoid the noises generated during vibration so as to improve the sound effects further. Moreover, lower cover 2 is provided with audio input interface 15, power supply interface 13 and switch 14, which are connected to the control circuit board; upper cover 1 is provided with sound hole 16.

In order to improve the operational stability, the axes of upper cover 1, lower cover 2, magnet fitted inside vibrating tone generator 3, pedestal 2, $1^{st}$ vibration transferring body 10 and $2^{nd}$ vibration transferring body 11 coincide with each other.

Prior to operation, in order to attain a perfect resonant effect, rotate upper cover 1 for a certain angle to release the buckled state of upper cover 1 and lower cover 2 such that upper cover 1 and lower cover 2 may be kept open by blow-molded spring 5 (as shown in FIG. 2). Connect audio input terminal 15 of the portable vibration speaker to tone source equipment, connect an electric power supply to power supply interface 13. The varying music signals are processed by the control circuit board, enter into surround coil 9 such that surround coil 9 generates a varying magnetic field. Under the action of the varying magnetic field, $1^{st}$ vibration transferring body 10 and $2^{nd}$ vibration transferring body 11 start vibrating. Music of different sound quality may be given once the vibrational energy is transferred to the surface of a hard medium; the music features superior sound quality effects, and the user may enjoy the music that makes for comfort as much as he likes.

Only the preferred embodiments of the invention are described above, and the above-mentioned specific embodiments are not intended to restrict the invention. Many modifications and variations of the present invention will be apparent to one of ordinary skill in the art in light of the teachings of this invention. All retouches, modifications or equipollent replacements performed by ordinary technicians of the art in accordance with the above-mentioned description fall within the scope of protection of the invention.

What is claimed is:

1. A portable vibration speaker comprising:

an upper cover;

a lower cover;

a vibrating tone generator;

a control circuit board; and a blow-molded spring;

wherein the vibrating tone generator and control circuit board are fitted inside the lower cover and an inside of the upper cover is fitted with a speaker; wherein one end of the blow-molded spring is connected to the upper cover, and the other end is connected to the lower cover in rotating mode; an inner wall of the upper cover is provided with buckles, and buckle flutes are arranged on the lower cover corresponding to the buckles; wherein the vibrating tone generator comprises a pedestal, a magnet and a surround coil, an upper and lower ends of the pedestal are provided with a first vibration transferring body and a second vibration transferring body respectively, the first and second vibration transferring bodies move up and down relative to the pedestal, the first vibration transferring body is connected to a coil sleeve, the surround coil is fitted on the coil sleeve, the magnet is fitted inside the coil sleeve, and a magnetizer is fitted over the magnet.

2. A portable vibration speaker as claimed in claim 1, wherein the lower cover is provided with an audio input interface, a power supply interface and a switch respectively connected to the control circuit board.

3. A portable vibration speaker as claimed in claim 1, wherein the second vibration transferring body extends out of the lower cover.

4. A portable vibration speaker as claimed in claim 1, wherein the second vibration transferring body is provided with a rubber pad.

5. A portable vibration speaker as claimed in claim 1, wherein the upper cover is provided with a sound hole.

* * * * *

UNITED STATES PATENT AND TRADEMARK OFFICE

CERTIFICATE OF CORRECTION

PATENT NO. : 8,867,771 B2
APPLICATION NO. : 13/580380
DATED : October 21, 2014
INVENTOR(S) : Qingkai Mei It is certified that error appears in the above-identified patent and that said Letters Patent is hereby corrected as shown below:

On the title page item (73), the name of the 1st Assignee was misspelled as "Qingkai Mel" and should be corrected to "Qingkai Mei".

Signed and Sealed this
Seventeenth Day of November, 2015

Michelle K. Lee

Michelle K. Lee
*Director of the United States Patent and Trademark Office*